US008944549B2

(12) United States Patent
Blair et al.

(10) Patent No.: US 8,944,549 B2
(45) Date of Patent: Feb. 3, 2015

(54) NOZZLE LAYOUTS FOR PRINTHEADS

(71) Applicant: Hewlett-Packard Development Company, L.P., Houston, TX (US)

(72) Inventors: Dustin W. Blair, Escondido, CA (US); Lawrence H. White, Corvallis, OR (US); Sean P. McClelland, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/924,799

(22) Filed: Jun. 24, 2013

(65) Prior Publication Data

US 2014/0375710 A1 Dec. 25, 2014

(51) Int. Cl.
*B41J 2/045* (2006.01)
*B41J 2/07* (2006.01)
*B41J 2/14* (2006.01)

(52) U.S. Cl.
CPC . *B41J 2/07* (2013.01); *B41J 2/1433* (2013.01)
USPC ..... 347/9; 347/47

(58) Field of Classification Search
USPC ..... 347/20, 47, 9
See application file for complete search history.

(56) References Cited

U.S. PATENT DOCUMENTS

| | | | | |
|---|---|---|---|---|
| 6,203,145 | B1 | 3/2001 | Jeanmaire et al. | |
| 6,527,369 | B1 * | 3/2003 | Weber et al. | 347/47 |
| 7,484,836 | B2 | 2/2009 | Moynihan | |
| 7,887,159 | B2 | 2/2011 | Takei et al. | |
| 8,354,062 | B2 | 1/2013 | Mantell et al. | |
| 2005/0282669 | A1 * | 12/2005 | Bauer et al. | 474/117 |
| 2005/0285901 | A1 * | 12/2005 | Nelson et al. | 347/54 |
| 2007/0216723 | A1 * | 9/2007 | Urech | 347/40 |
| 2013/0021411 | A1 * | 1/2013 | Feinn et al. | 347/47 |

OTHER PUBLICATIONS

Hoath, S.D. et al.; Dependence of Drop Speed on Nozzle Diameter, Viscosity and Drive Amplitude in Drop-on-demand Ink-jet Printing; Proc 27th Int. Conf. on Digital Printung Technologies; Jul. 4, 2011; pp. 62-65.

* cited by examiner

*Primary Examiner* — Julian Huffman
*Assistant Examiner* — Sharon A Polk
(74) *Attorney, Agent, or Firm* — Hewlett-Packard Patent Department

(57) ABSTRACT

Nozzle layouts for printheads are described. In an example, a printhead includes a first set of drop ejectors having orifices with circular bores, and a second set of drop ejectors having orifices with non-circular bores. A processor receives printing data representing an image to be printed to media, and provides firing data to the printhead for activating the drop ejectors. The firing data selects the drop ejectors with the circular bores to print graphic elements of the image and selecting the drop ejectors with the non-circular bores to print textual elements or line elements of the image.

12 Claims, 5 Drawing Sheets

108

500

NOZZLE LAYOUTS FOR PRINTHEADS

BACKGROUND

Inkjet technology is widely used for precisely and rapidly dispensing small quantities of fluid. Inkjets eject droplets of fluid out of a nozzle by creating a short pulse of high pressure within a firing chamber. During printing, this ejection process can repeat thousands of times per second. Ideally, each ejection would result in a single ink droplet that travels along a predetermined velocity vector for deposition on the media. In practice, however, the ejection process may create a number of very small droplets that remain airborne for longer than ideal periods of time and are not depositing at the desired location on the media. This non-ideal ejection process can affect the printing process differently, depending what is printed, such as text, lines, or graphics.

BRIEF DESCRIPTION OF THE DRAWINGS

Some embodiments of the invention are described with respect to the following figures.

DETAILED DESCRIPTION

Figure 1:
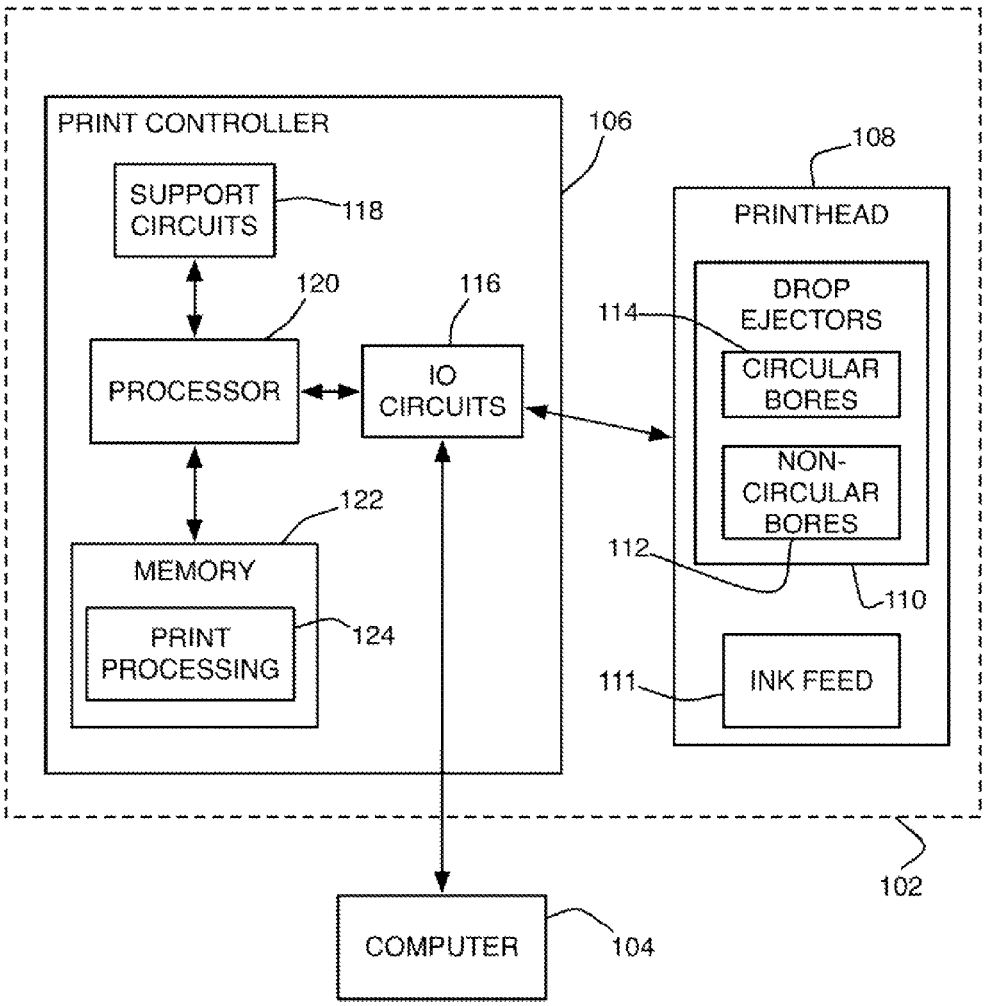
FIG. 1 is a block diagram of an ink jet printer according to an example implementation.

FIG. 1 is a block diagram of an ink jet printer 102 according to an example implementation. The ink jet printer 102 includes a print controller 106 and a printhead 108. The print controller 106 is coupled to the printhead 108. The print controller 106 receives printing data representing an image to be printed to media (media not shown for clarity). The print controller 106 generates firing data for activating drop ejectors on the printhead 108 to eject ink onto the media and produce the image. The print controller 106 provides the firing data to the printhead 108 based on the printing data.

The print controller 106 includes a processor 120, a memory 122, input/output (IO) circuits 116, and various support circuits 118. The processor 120 can include any type of microprocessor known in the art. The support circuits 118 can include cache, power supplies, clock circuits, data registers, and the like. The memory 122 can include random access memory, read only memory, cache memory, magnetic read/write memory, or the like or any combination of such memory devices. The IO circuits 116 can by coupled to the printhead module 110. The IO circuits 116 can also be coupled to external devices, such as a computer 104. For example, the IO circuits 116 can receive printing data from an external device (e.g., the computer 104), and provide firing data to the printhead 108 using the IO circuits 116.

The memory 120 can include a print processing function 124. The print processing function 124 can include machine-readable instructions executable by the processor 120 to perform various functions, including processing printing data and generating firing data for the printhead 108. The print processing function 124 can be stored in any portion of the memory 120, for example, in a non-volatile portion of the memory 120 (e.g., as "firmware" for the printer 120). The print processing function 124 and the memory 120 together comprise a computer-readable medium having machine-readable instructions executable by the processor 120 to perform various functions described below.

The printhead 108 includes a plurality of drop ejectors 110 and ink feed slot(s) 111. The drop ejectors 110 are in fluidic communication with the ink feed slot(s) 111 for receiving ink. Ink can be provided to the ink feed slots from a container (not shown for simplicity). In an example, the printhead 108 is a thermal ink jet (TIJ) device. The drop ejectors 110 generally include a heating element, a firing chamber, and a nozzle. Ink from the ink feed slot(s) 111 fills the firing chambers. To eject a droplet, an electrical current is passed through the heater element placed adjacent to the firing chamber. The heating element generated heat, which vaporizes a small portion of the fluid within the firing chamber. The vapor rapidly expends, forcing a small droplet out of the firing chamber and nozzle. The electrical current is then turned off and the resistor cools. The vapor bubble rapidly collapses, drawing more fluid into the firing chamber from the ink feed slot(s) 111.

In another implementation, the printhead 108 is a piezoresistive device, where electric voltage is applied across a piezoresistive material to cause a diaphragm to change shape to expel printing liquid in a firing chamber through an associated nozzle. In still other implementations, other drop ejection or firing mechanisms may be used to selectively eject printing drops through nozzles. As used herein, "firing data" indicates data for activating/deactivating the drop ejectors 110 given the particular physical implementation.

Some of the drop ejectors 110 include nozzles with circular bores 114, and others of the drop ejectors 110 include nozzles with non-circular bores 112. The circular bores 114 have a cross-section that is circular or substantially circular in shape. The non-circular bores 112 have a cross-section being a shape formed from an ellipse, a combination of ellipses, a combination of circles, a combination of ellipse(s) and circle(s), or other non-circular shapes or combinations thereof.

The inventors have found that non-circular nozzles provide good dot shape, particularly at high scanning speeds relative to circular nozzles. Non-circular nozzles provide a benefit as ink jet printing systems operate at higher speeds. While non-circular nozzles are adept at printing crisp, clear text and lines, they are less effective at printing graphics. The round dots produced by non-circular nozzles have been found to result in more visible printing defects in images and filled areas due to less coverage of white space. Circular nozzles produce less visible printing defects when printing graphics than non-circular nozzles due to the increase in the number of individual droplets covering a wider area of the print media.

The print processing function 124 receives printing data representing an image to be printed to media. The image may have text elements, line elements, graphic elements, or a combination of such elements. The print processing function 124 generates firing data for the drop ejectors 110 on the printhead 108. The firing data is generated such that drop ejectors 110 with the circular bores 114 are selected (e.g., "fired") to print graphic elements, and drop ejectors 110 with the non-circular bores 112 are selected (fired) to print textual and line elements. The print processing function 124 can establish various predefined criteria to distinguish between textual/line elements and graphic elements on an image to be printed.

Figure 2:
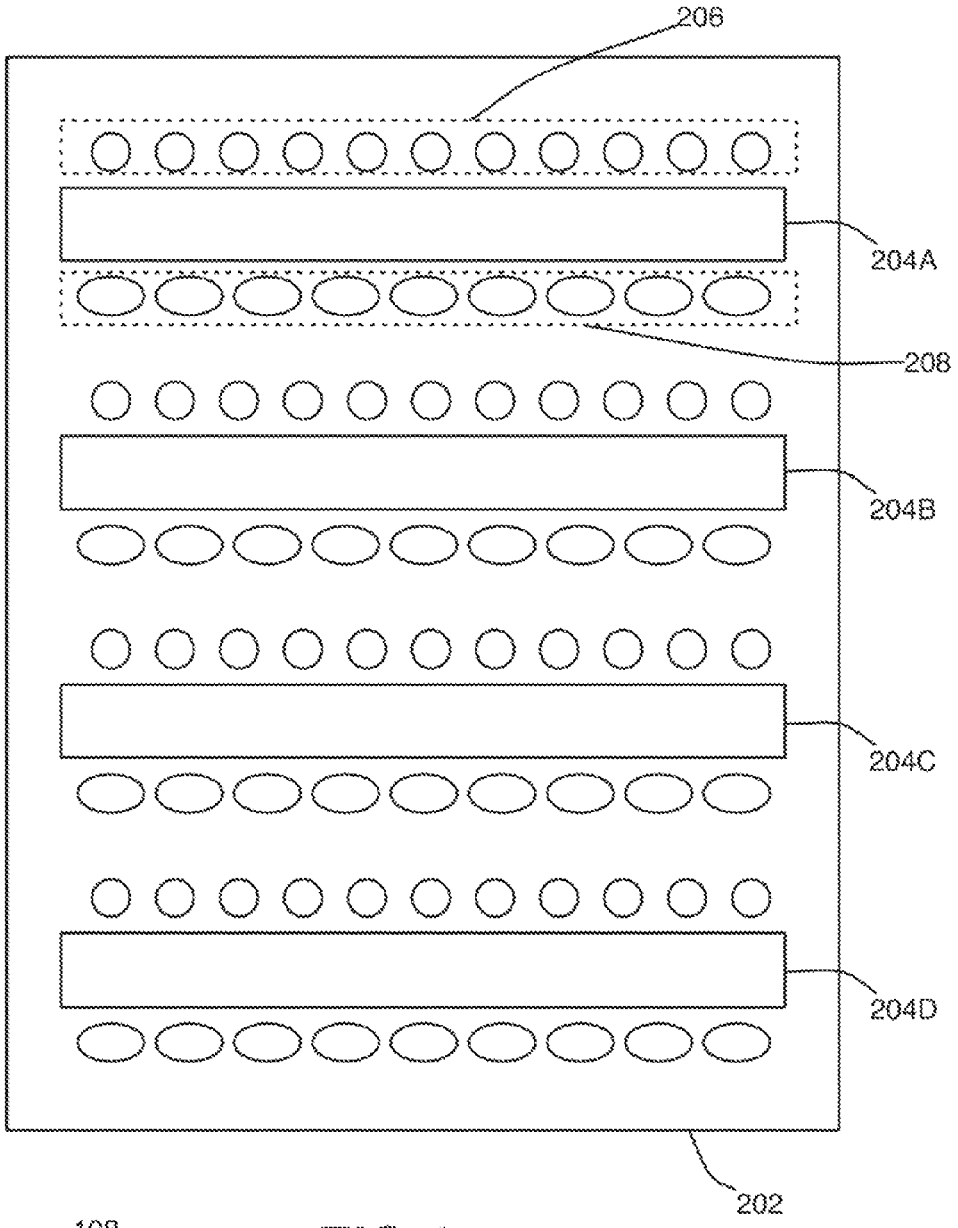
FIG. 2 illustrates a more detailed view of a printhead according to an example implementation.

FIG. 2 illustrates a more detailed view of the printhead 108 according to an example implementation. The printhead 108 includes a substrate 202 forming or providing ink feed slots 204A through 204D (collectively referred to as ink feed slots 204 or slots 204) to direct inks received from a supply (not shown for simplicity) to the drop ejectors 110 extending along opposite sides of each of the slots 204. In one implementation, ink feed slots 204 supply color inks, black inks, or a combination of color and black inks. Although four ink feed slots 204 are shown by example, the printhead 108 can generally include at least one ink feed slot.

First rows 206 if the drop ejectors 110 extend along first sides of the ink feed slots 204, and second rows 208 of the drop ejectors 110 extend along second sides of the ink feed slots 204. That is, for each of the ink feed slots 204, a first row of the drop ejectors 110 is on one side, and a second row of the drop ejectors 110 is on the other side. The first rows 206 of the drop ejectors 110 include nozzles having circular bores, and the second rows 208 of the drop ejectors 110 include nozzles having non-circular bores (generally shown having an elliptical cross-section by example). In an example, half of the drop ejectors 110 on the printhead 108 having nozzles with circular bores, and half have nozzles with non-circular bores (e.g., a 1:1 ratio of circular-to-non-circular nozzles). In other examples, the ratio of circular-to-non-circular nozzles on the printhead 108 can be greater than or less than one.

Figure 3:
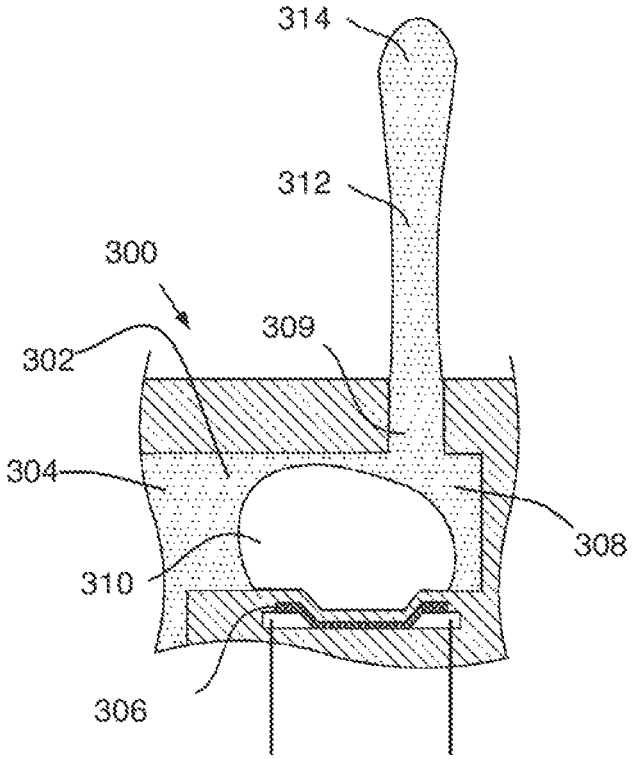
FIG. 3 is a side cross-section view of a thermal ink jet drop ejector according to an example implementation.

FIG. 3 is a side cross-section view of a thermal ink jet drop ejector 300 according to an example implementation. The drop ejector 300 includes a firing chamber 302, which is fluidically connected to a fluid reservoir 304. A heating element 306 is located in proximity to the firing chamber 302. Fluid 308 enters the firing chamber 302 from the fluid reservoir 304. When an electric current passes through the heating element 306, a portion of the fluid 308 is vaporized creating a vapor bubble 310. The expanding vapor bubble 310 forces fluid 308 to be ejected through a nozzle 309 that is fluidically connected to the firing chamber 302. The ejected fluid forms an ink drop that can have a tail portion 312 and a head portion 314. When viewed from the top, the nozzle 308 can have a circular bore or a non-circular bore. A circular bore can have a circular shape or a substantially circular shape. Examples of non-circular bores are described below.

Figure 4:
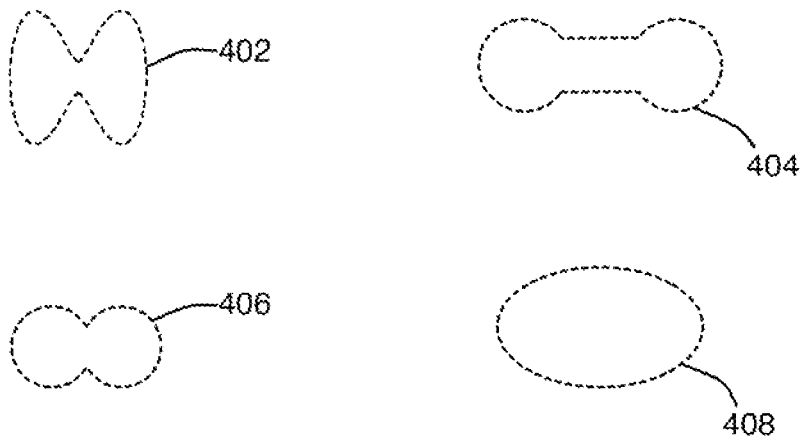
FIG. 4 depicts example implementations of non-circular nozzle geometries.

FIG. 4 depicts example implementations of non-circular nozzle geometries. The example geometries can be formed from elliptical shapes, circular shapes, or a combination of elliptical and circular shapes. For example, geometry 402 shows an "hourglass" shape. A geometry 404 shows a "dumbbell" or "dog bone" shape. A geometry 406 shows a "figure-8" shape. A geometry 408 shows an elliptical shape. It is to be understood that the geometries shown in FIG. 4 are examples of non-circular bores and that other types of non-circular bores can be used in the present examples of printheads.

Figure 5:
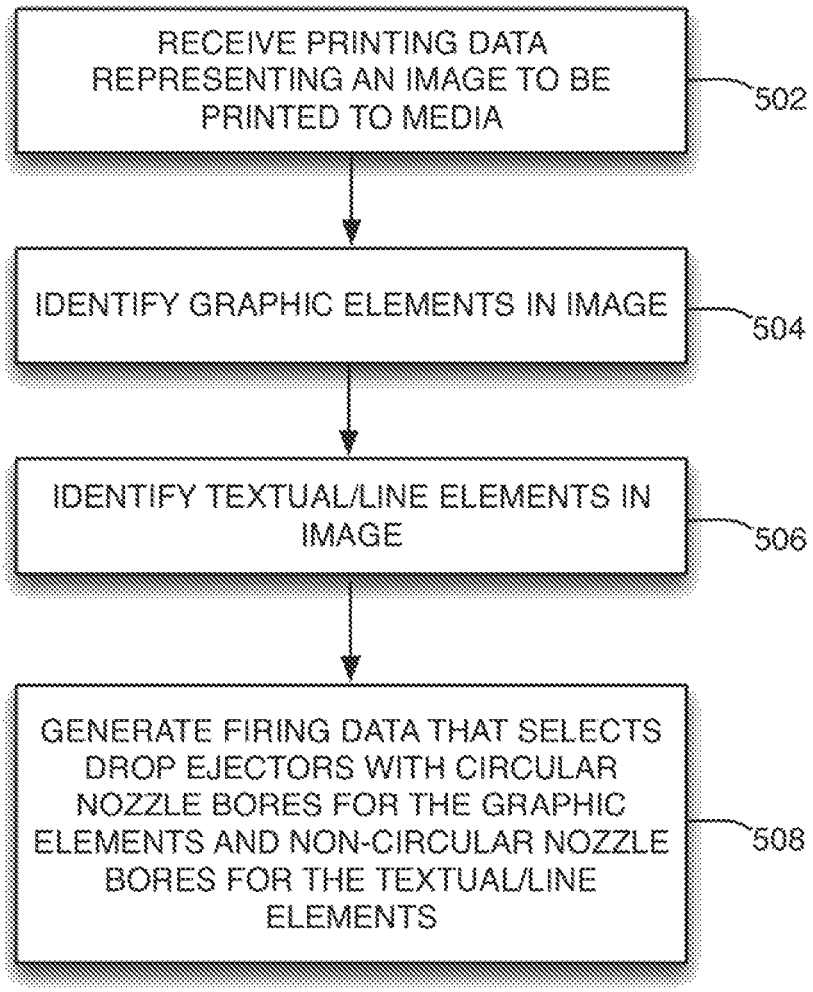
FIG. 5 is a flow diagram depicting a method of ink jet printing according to an example implementation.

FIG. 5 is a flow diagram depicting a method 500 of ink jet printing according to an example implementation. The method 500 begins at step 502, where printing data is received representing an image to be printed to media. At step 504, graphic elements are identified in the image. At step 506, textual elements and/or line elements are identified in the image. At step 508, firing data is generated for activating drop ejectors on a printhead that selects drop ejectors having circular bores for the graphic elements and drop ejectors having non-circular bores for the textual/line elements. In an example, the method 500 may be performed by the print processing function 124 in the print controller 106 shown in FIG. 1.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A printhead, comprising:

a substrate having at least one ink feed slot formed therein;

a first row of drop ejectors extending along a first side of each of the at least one ink feed slot;

a second row of drop ejectors extending along a second side of each of the at least one ink feed slot;

the drop ejectors in each first row having orifices with circular bores; and the drop ejectors in each second row having orifices with non-circular bores, each non-circular bore having a shape that is one of:

a first shape defined as a pair of overlapping circles;

a second shape defined as a pair of ellipses that are extended towards one another on facing edges thereof such that the ellipses join together;

a third shape defined as an ellipse;

a fourth shape defined as a pair of circles joined together by a rectangle that overlaps each circle.

2. The printhead of claim 1, wherein the drop ejectors having circular bores comprise one half of a total number of drop ejectors on the printhead, and the drop ejectors having non-circular bores comprise one half of the total number of drop ejectors.

3. The printhead of claim 1, wherein at least one of the non-circular bores has the first shape.

4. The printhead of claim 1, wherein at least one of the non-circular bores has the second shape.

5. The printhead of claim 1, wherein at least one of the non-circular bores has the third shape.

6. The printhead of claim 1, wherein at least one of the non-circular bores has the fourth shape.

7. A printing system, comprising:

a printhead including a first set of drop ejectors having orifices with circular bores, and a second set of drop ejectors having orifices with non-circular bores; and a processor to receive printing data representing an image to be printed to media, and to provide firing data to the printhead for activating the drop ejectors, the firing data selecting the drop ejectors with the circular bores to print graphic elements of the image and selecting the drop ejectors with the non-circular bores to print textual elements or line elements of the image.

8. The printing system of claim 7, wherein the printhead includes at least one ink feed slot formed on a substrate, where drop ejectors from the first set are disposed along a first side of each of the at least one ink feed slot, and drop ejectors from the second set are disposed along a second side of each of the at least one ink feed slot.

9. The printing system of claim 7, wherein the drop ejectors having circular bores comprise one half of a total number of drop ejectors on the printhead, and the drop ejectors having non-circular bores comprise one half of the total number of drop ejectors.

10. A method of ink jet printing, comprising:

receiving printing data representing an image to be printed to media;

identifying graphic elements in the image;

identifying textual elements or line elements in the image;

generating firing data for activating drop ejectors on a printhead, where the firing data selects drop ejectors having circular bores for the graphic elements and selects drop ejectors having non-circular bores for the textual elements or the line elements.

11. The method of claim 10, wherein the drop ejectors having circular bores comprise one half of a total number of drop ejectors on the printhead, and the drop ejectors having non-circular bores comprise one half of the total number of drop ejectors.

12. The method of claim 10, wherein the printhead includes at least one ink feed slot formed on a substrate, where drop ejectors having circular bores disposed along a first side of each of the at least one ink feed slot, and drop ejectors having non-circular bores are disposed along a second side of each of the at least one ink feed slot.

* * * * *